United States Patent [19]

Nakagawa

[11] Patent Number: 4,825,837

[45] Date of Patent: May 2, 1989

[54] AIR/FUEL RATIO CONTROL SYSTEM HAVING GAIN ADJUSTING MEANS

[75] Inventor: Toyoaki Nakagawa, Yokohama, Japan

[73] Assignee: Nissan Motor Co., Ltd., Yokohama, Japan

[21] Appl. No.: 38,783

[22] Filed: Apr. 15, 1987

[30] Foreign Application Priority Data

Apr. 18, 1986 [JP] Japan ..... 61-88203

[51] Int. Cl.[4] ..... F02D 41/14

[52] U.S. Cl. ..... 123/489

[58] Field of Search ..... 123/489, 589, 440

[56] References Cited

U.S. PATENT DOCUMENTS

| | | | |
|---|---|---|---|
| 4,355,618 | 10/1982 | Müller et al. | 123/489 |
| 4,528,961 | 7/1985 | Katoh et al. | 123/489 |
| 4,561,403 | 12/1985 | Oyama et al. | 123/489 |
| 4,592,325 | 6/1986 | Nakagawa | 123/489 |
| 4,748,953 | 6/1988 | Osuga et al. | 123/440 |

FOREIGN PATENT DOCUMENTS

| | | |
|---|---|---|
| 0136519 A2 | 8/1984 | European Pat. Off. . |
| DE 3039436 A1 | 5/1982 | Fed. Rep. of Germany . |
| DE 3630847 A1 | 3/1987 | Fed. Rep. of Germany . |
| 58-144642 | 8/1983 | Japan . |
| 58-195048 | 11/1983 | Japan . |
| 60-178942 | 9/1985 | Japan . |

*Primary Examiner*—Andrew M. Dolinar

*Attorney, Agent, or Firm*—Foley & Lardner, Schwartz, Jeffery, Schwaab, Mack, Blumenthal & Evans

[57] ABSTRACT

An air/fuel ratio control system for an internal combustion engine is composed of a wide range oxygen sensor capable of sensing an actual air/fuel ratio from a rich side to a lean side, and a control unit having a reference determining section for determining a desired air/fuel ratio in accordance with engine operating conditions such as engine speed and coolant temperature, and a controlling section for controlling a fuel metering system such as fuel injectors so as to reduce a deviation of the actual air/fuel ratio from the desired air/fuel ratio in accordance with a prescribed control action such as a proportional plus integral control action. The control unit is further provided with a reference discriminating section for determining whether the desired air/fuel ratio is in a rich range or in a lean range, and a feedback control constant adjusting section for adjusting at least one control constant such as a proportional gain and an integral gain in dependence on the determination of the reference discriminating section to enable the controlling section to implement the optimum feedback control over the wide range.

14 Claims, 8 Drawing Sheets

| TL | LEAN DEVIATION | | RICH DEVIATION | |
|---|---|---|---|---|
| | P | I | P | I |
| LEAN | KpLL | KiLL | KpRL | KiRL |
| STOICH | KpLS | KiLS | KpRS | KiRS |
| RICH | KpLR | KiLR | KpRR | KiRR |

AIR/FUEL RATIO CONTROL SYSTEM HAVING GAIN ADJUSTING MEANS

BACKGROUND OF THE INVENTION

The present invention relates to an air/fuel ratio control system for an internal combustion engine, for example, of a motor vehicle, and more specifically to such a control system capable of implementing a feedback air/fuel ratio control over a wide range from a rich side to a lean side.

A conventional air/fuel ratio control system is arranged to perform a feedback control only when the engine is warmed up sufficiently and in a limited engine operating region in which a stoichiometric air/fuel ratio is required, and to perform an open loop control without feedback in a warm up period after cold start or in a high engine load region. Therefore, the control accuracy is low, and the exhaust performance and drivability are poor especially in the warm-up period and in the high load region because the open loop control is unable to compensate for undesired influences of production tolerance, wear and aging of the engine and fuel metering system.

Furthermore, in order to improve the fuel economy by utilizing lean combustion of a lean air/fuel mixture, it is important to perform an accurate feedback air/fuel ratio control on the lean side.

Japanese patent provisional publication No. 60-178942 discloses an improved air/fuel ratio control system which has a so-called wide range air/fuel ratio sensor capable of sensing the air/fuel ratio over the wide range from the rich side to the lean side, and a controller capable of performing a feedback control in which a desired air/fuel ratio is varied from the rich side to the lean side in accordance with engine operating conditions.

In this control system, however, a feedback control constant such as a proportional gain of a proportional control action and an integral gain of an integral control action is held unchanged at a fixed value irrespectively of whether the desired air/fuel ratio is lean or rich, so that an accurate and stable feedback control performance cannot be obtained.

SUMMARY OF THE INVENTION

It is an object of the present invention to provide an air/fuel ratio control system capable of providing an accurate and stable feedback control over the wide range from the rich side to the lean side.

According to the present invention, an air/fuel ratio control system for an internal combustion engine comprises (i) metering means, (ii) air/fuel ratio sensing means, (iii) reference determining means, (iv) controlling means, (v) discriminating means and (vi) adjusting means.

The metering means is for varying an air/fuel ratio of an air-fuel mixture supplied to the engine under control in response to a control signal. The metering means may be a carburetor system or may be a fuel injection system.

The air/fuel ratio sensing means is for sensing an actual air/fuel ratio of the engine. The sensing means generally comprises an oxygen sensor exposed to an exhaust gas mixture of the engine.

The reference determining means is for determining a desired air/fuel ratio in accordance with an operating condition of the engine. For example, the desired air/fuel ratio is determined in accordance with engine speed, engine load and engine coolant temperature.

The controlling means compares the actual air/fuel ratio with the desired air/fuel ratio, and controls the air/fuel ratio of the air-fuel mixture supplied to the engine so as to reduce a deviation of the actual air/fuel ratio from the desired air/fuel ratio by producing the control signal in accordance with the deviation by using a feedback control constant. The feedback control constant may be one of a proportional gain of a proportional control action, an integral gain of an integral control action and a derivative gain of a derivative control action. For example, the control signal is produced by following a proportional plus integral control action (or control law).

The discriminating means compares the desired air/fuel ratio with a predetermined value. Thus, the discriminating means determines whether the desired air/fuel ratio is in a rich range or in a lean range.

The adjusting means changes the value of the feedback control constant used by the controlling means in dependence upon a result of the comparison performed by the discriminating means. The adjusting means may be arranged to adjust both of the proportional gain and the integral gain when the PI control action is employed.

DETAILED DESCRIPTION OF THE INVENTION

Figure 1:
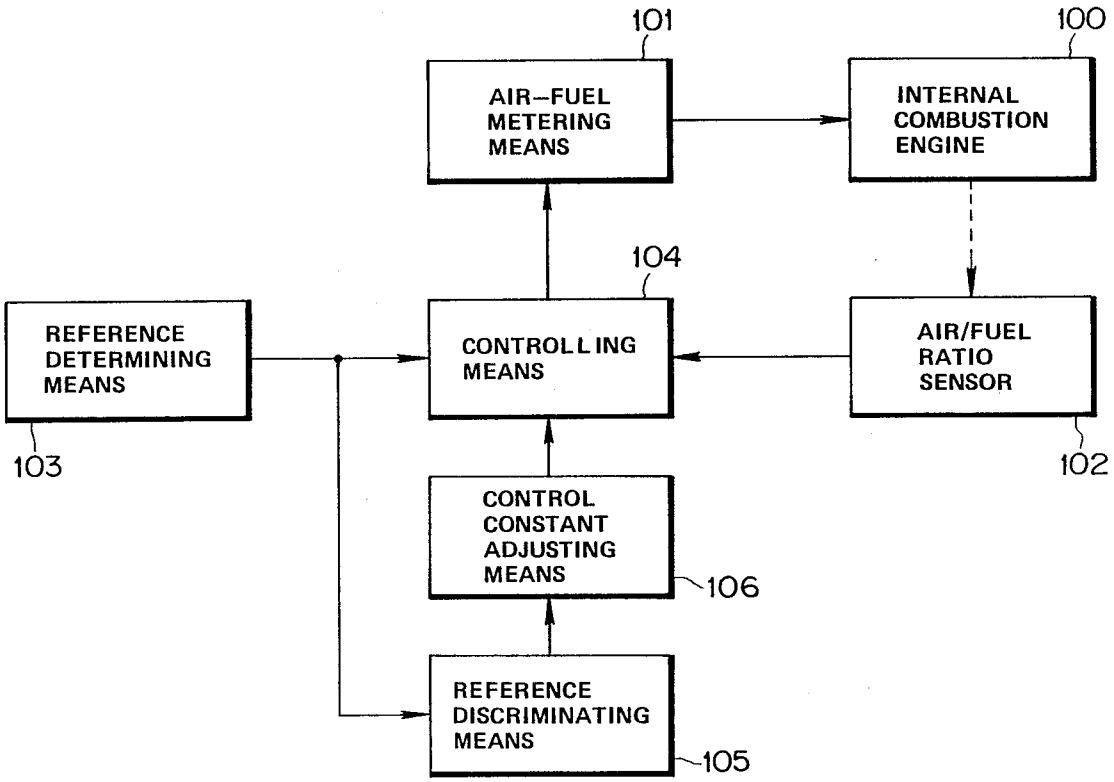
FIG. 1 is a functional block diagram schematically showing an air/fuel control system of the present invention.

As shown in FIG. 1, an air/fuel control system for an internal combustion engine 100, of the present invention comprises an air-fuel metering means 101, an air/fuel ratio sensor 102, reference determining means 103, controlling means 104, reference discriminating means 105 and control constant adjusting means 106.

Figure 2:
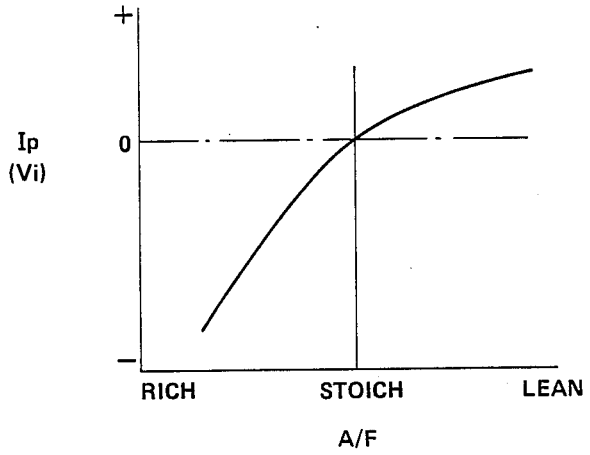
FIGS. 2 and 3 are graphs showing characteristics of an air/fuel ratio sensor.
Figure 3:
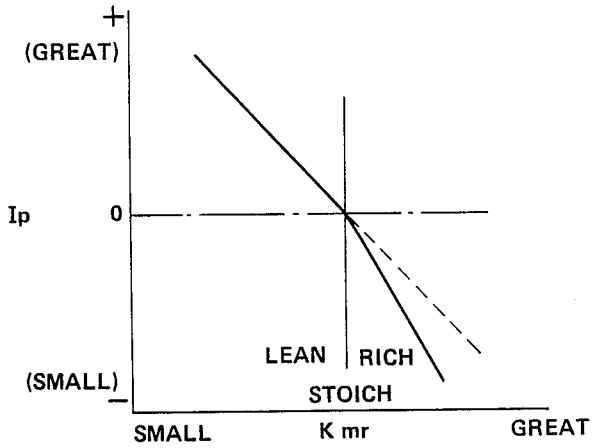

From a series of experiments on an air/fuel ratio sensor of a wide range type capable of sensing the air/fuel ratio over the wide range from the rich side to the lean side, it has been realized that the output characteristic of the air/fuel ratio sensor is not the same on the rich side as it is on the lean side, as shown in FIGS. 2 and 3. In a characteristic curve shown in FIG. 2, the slope of the sensor output Ip with respect to the air/fuel ratio (A/F) is steeper on the rich side than on the lean side separated from the rich side by a vertical line indicating a stoichiometry at which an equivalent ratio (lambda = 1.0). Similarly, in a characteristic curve of FIG. 3 between the sensor output Ip and Kmr which is the reciprocal of the air/fuel ratio (A/F) and which corresponds to a fuel injection pulse duration (or width), the slope is steep on the rich side and gradual on the lean side. Accordingly, it is found that an accurate and stable feedback air/fuel ratio control performance cannot be obtained if the feedback control characteristic is the same on the rich and lean sides, as in the conventional control system.

Figure 4:
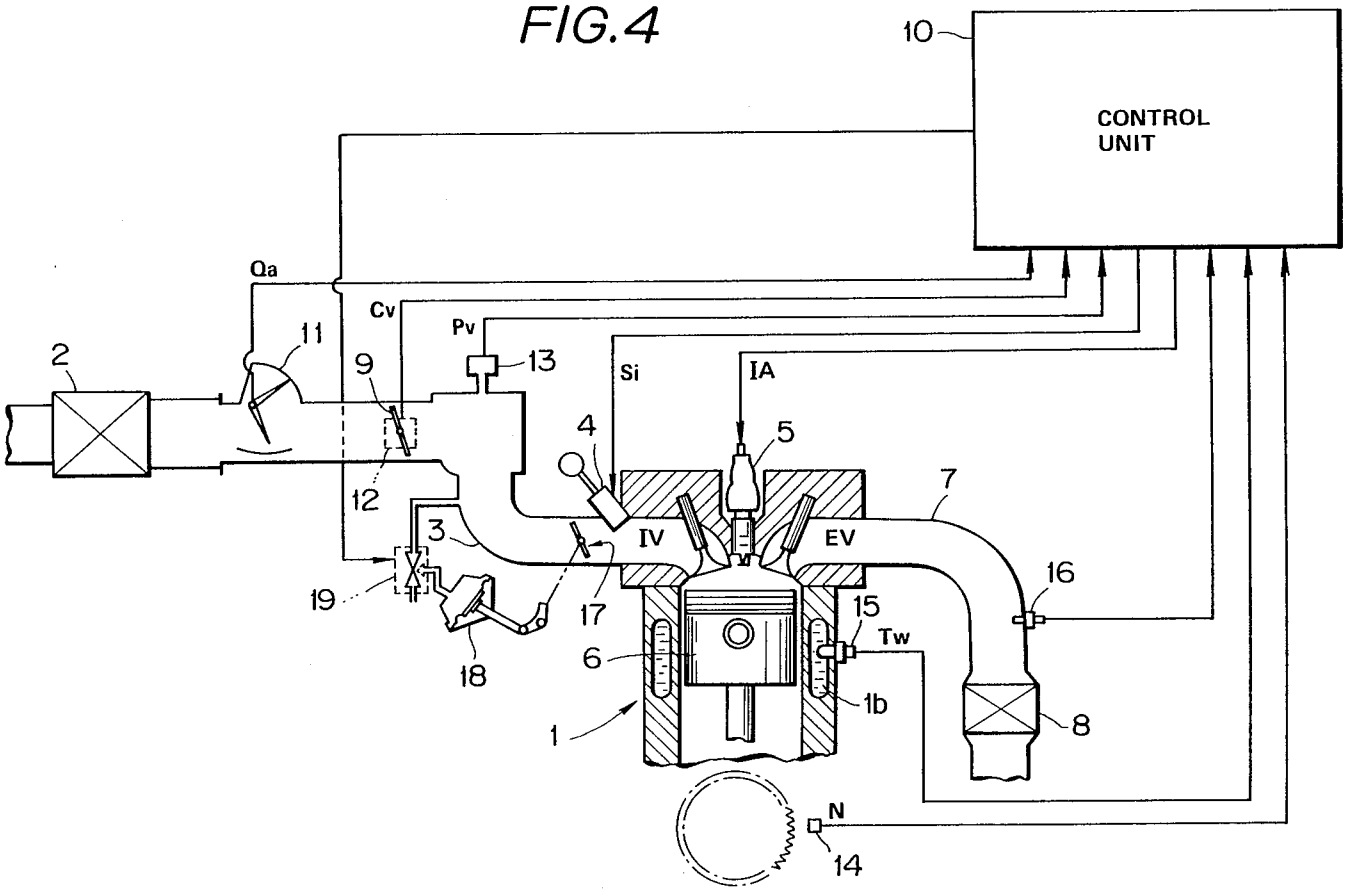
FIG. 4 is a schematic illustration of a control system for an internal combustion engine for showing one embodiment of the present invention.

FIG. 4 shows one embodiment of the present invention.

An engine 1 shown in FIG. 4 is of the fuel injection type. An intake air is introduced into each combustion chamber 1*a* of the engine 1 from an air cleaner 2 through an intake passage 3. The amount of the intake air is controlled by a throttle valve 9 disposed in the intake passage 3. Fuel is injected by each fuel injector 4 under the command of a fuel injection control signal Si delivered from a control unit 10.

The air-fuel charge in each combustion chamber 1*a* is ignited by a spark plug 5 under the command of an ignition control signal IA delivered from the control unit 10. Thus, a piston 6 of each cylinder is reciprocated. In FIG. 4, an ignition circuit including an ignition coil is omitted for simplification.

An exhaust gas mixture of the engine 1 is introduced through an exhaust passage 7 into a catalytic converter 8 which reduces harmful exhaust emissions (such as HC, CO and NOx) with three-way catalyst.

The control system shown in FIG. 4 includes an air flowmeter 11 for measuring an intake air flow rate Qa, a throttle position sensor 12 for sensing an opening degree Cv of the throttle valve 9, and a pressure sensor 13 for sensing a pressure (intake manifold pressure) at a position downstream of the throttle valve 9.

The control system of FIG. 4 further includes a crank angle sensor 14 for producing a pulse signal indicative of an engine rpm N, a coolant temperature sensor 15 for sensing a temperature Tw of a cooling water flowing through a water jacket 1*b* of the engine 1, and an oxygen sensor 16 for sensing the oxygen content in the exhaust gases.

A reference numeral 17 denotes a swirl valve which is disposed in the intake passage 3 near the injector 4. The swirl valve 17 is opened and closed by an actuating valve 18 which is operated by a negative pressure introduced through a solenoid valve 19. The solenoid valve 19 is controlled by a signal delivered from the control unit 10.

As disclosed in Japanese patent provisional publication No. 58-195048, the swirl valve 17 is designed to produce swirl in each combustion chamber 1*a* to expedite the combustion when the swirl valve 17 is closed to narrow the intake passage and cause the intake mixture to flow a helical port. The swirl valve 17 is effective means for obtaining stable combustion at a leaner air/fuel ratio.

The engine 1 further has an intake valve IV and an exhaust valve EV for each cylinder.

The control unit 10 of this example is designed to perform an ignition timing control and a swirl valve control as well as the air/fuel ratio control according to the present invention. The signals of the air flowmeter 11 and the sensors 12–16 are inputted into the control unit 10. In accordance with these input signals, the control unit 10 calculates a fuel injection quantity and an ignition timing, and produces the fuel injection control signal Si and the ignition control signal IA. The control unit 10 further produces a control signal which is sent to the solenoid valve 19 to open and close the swirl valve 17.

In this example, the control unit 10 is composed of a microcomputer, an output driver circuit, an air/fuel ratio detecting circuit, etc. The microcomputer includes a CPU, a memory section having ROM and RAM, an input/output interface (including A/D converter and D/A converter), et cetra.

Figure 5:
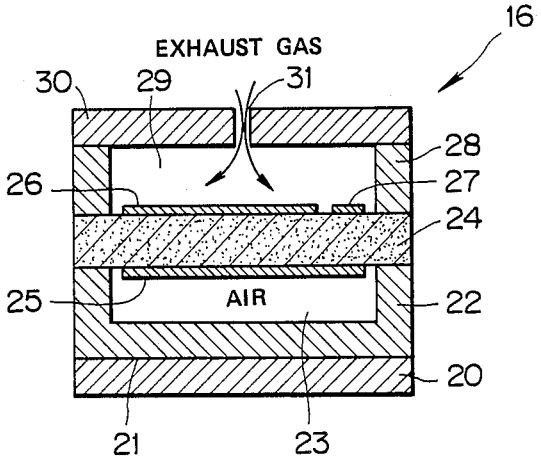
FIG. 5 is a schematic sectional view of an oxygen sensor used in the control system of FIG. 4.

The oxygen sensor 16 employed in this embodiment is shown in FIG. 5. A base plate 20 of the oxygen sensor 16 is provided with a heating element 21. A channel member 22 is placed on the base plate 20. The channel member 22 has a groove 23 into which an atmospheric air is introduced. A plate 24 of oxygen ion conductive solid electrolyte is placed on the channel member 22 to cover the groove 23. A reference electrode 25 is formed on a lower surface of the solid electrolyte plate 24. Pump electrode 26 and sensor electrode 27 are formed on an upper surface of the solid electrolyte plate 24. An intermediate member 28 having an opening is placed on the upper surface of the solid electrolyte plate 24, and a top plate 30 is placed on the intermediate member 28, so that an enclosed interior space 29 is formed between the solid electrolyte plate 24 and the top plate 30 by the opening of the intermediate member 28. The exhaust gases to be measured are introduced into the space 29. The top plate 30 is formed with a small hole 31 for controlling gas diffusion. The reference electrode 25 is enclosed in the space formed by the groove 23, and exposed to the air, while the pump and sensor electrodes 26 and 27 are enclosed in the space 29, and exposed to the exhaust gases.

The base plate 20, channel member 22, intermediate member 28 and the top plate 30 are made of a heat-resistant insulating material such as alumina or mullite, or a heat-resistant alloy. The solid electrolyte plate 24 is made of a sintered solid solution in which $Ca_2O$, MgO, $Y_2O_3$ or $YB_2O_3$ is dissolved in an oxygen ion conducting oxide such as $ZrO_2$, $HfO_2$, $ThO_2$, and $Bi_2O_3$.

Each of the electrodes 25–27 is made of a substance containing platinum or gold as a main component. The pump electrode 26 and reference electrode 25 form an oxygen pump cell for holding an oxygen partial pressure ratio between the upper and lower sides of the solid electrolyte plate 24 at a constant level by causing oxygen ions to move in the solid electrolyte plate 24. The sensor electrode 27 and reference electrode 25 form a sensor cell for sensing a potential difference produced by the difference in oxygen partial pressure between the upper and lower sides of the solid electrolyte plate 24.

Figure 6:
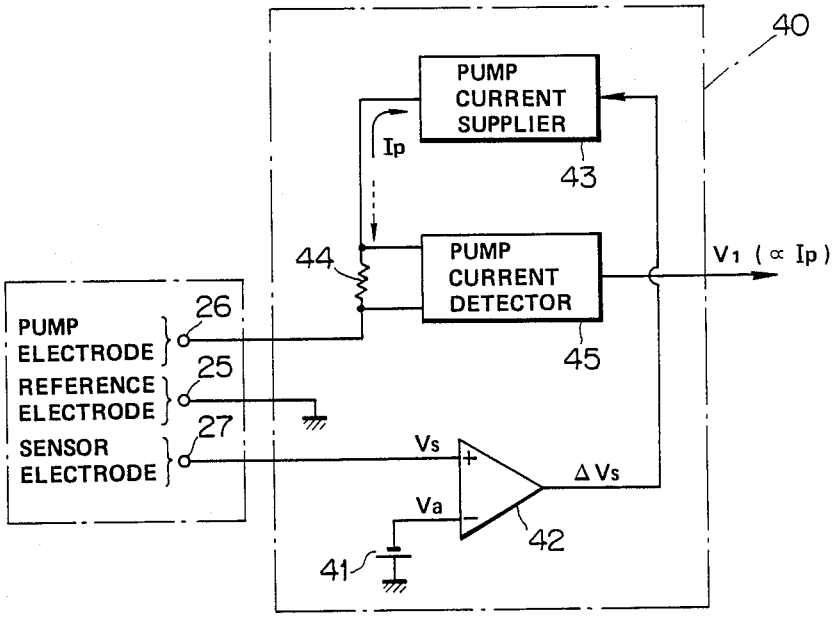
FIG. 6 is a schematic block diagram of an air/fuel ratio detecting circuit connected with the oxygen sensor of FIG. 5.

FIG. 6 shows an air/fuel ratio detecting circuit 40 connected with the oxygen sensor 16. The detecting circuit 40 is composed of a voltage source 41 for providing a target voltage Va (negative voltage), a differential amplifier 42, a pump current supplier section 43, a resistor 44, and a pump current detector section 45 for detecting a pump current Ip from a voltage across the resistor 44.

The differential amplifier 42 receives an electric potential Vs (negative voltage) of the sensor electrode 27 of the oxygen sensor 16 with respect to the reference electrode 25, and compares the potential Vs with the target voltage Va to calculate a difference delta-Vs ($\Delta Vs = Vs - Va$).

The pump current supplier section 43 causes the pump current Ip to flow out of or into the pump electrode 26 of the oxygen sensor 16 so as to hold the output, delta-Vs (ΔVs), of the differential amplifier 42 equal to zero. The pump current supplier section 43 increases the pump current Ip when delta-Vs (ΔVs) is positive, and decreases Ip when delta-Vs is negative.

The pump current detector section 45 receives the potential difference between both ends of the resistor 44, and delivers an output voltage Vi proportional to the pump current Ip ($Vi \propto Ip$). The pump current Ip flowing in the direction shown by a solid line arrow in FIG. 6 is regarded as positive. In this case, the output voltage Vi is made positive. When the pump current Ip is flowing in the opposite direction shown by a broken line arrow in FIG. 6, the output voltage Vi is negative.

The characteristic shown in FIG. 2, of the pump current Ip detected by the pump current detecting circuit 40 versus the air/fuel ratio (A/F), is obtained by setting the target voltage Va at a value corresponding to the potential difference developed between the reference and sensor electrodes 25 and 27 when the oxygen concentration of the gas mixture in the measuring space 29 of the oxygen sensor 16 is held at a predetermined value, that is, the oxygen partial pressure ratio between the upper and lower sides of the solid electrolyte plate 24 is held at a predetermined ratio value. Therefore, it is possible to sense the actual air/fuel ratio accurately over a wide range from the rich side to the lean side by using the oxygen sensor 16 and pump current detecting circuit 40. In this embodiment, the air/fuel ratio sensor 102 shown in FIG. 1 is constituted by the oxygen sensor 16 and the detecting circuit 40. Needless to add, the present invention can be embodied by using various other air/fuel sensors and detecting circuits.

In this embodiment, the microcomputer of the control unit 10 performs the functions of the four means 103–106 shown in FIG. 1. The control unit 10 of this embodiment controls the air/fuel ratio in the following manner.

Figure 7:
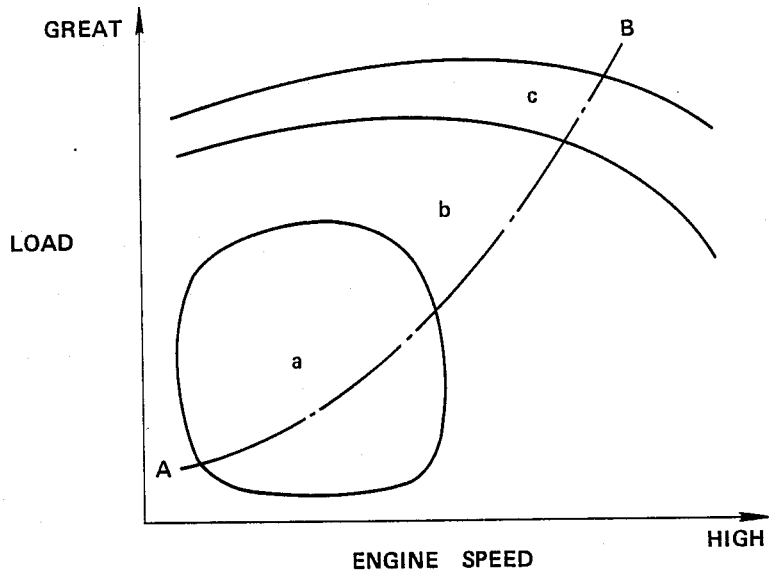
FIGS. 7 and 8 are graphs showing a variation of an air/fuel ratio required by an engine in a steady state.
Figure 8:
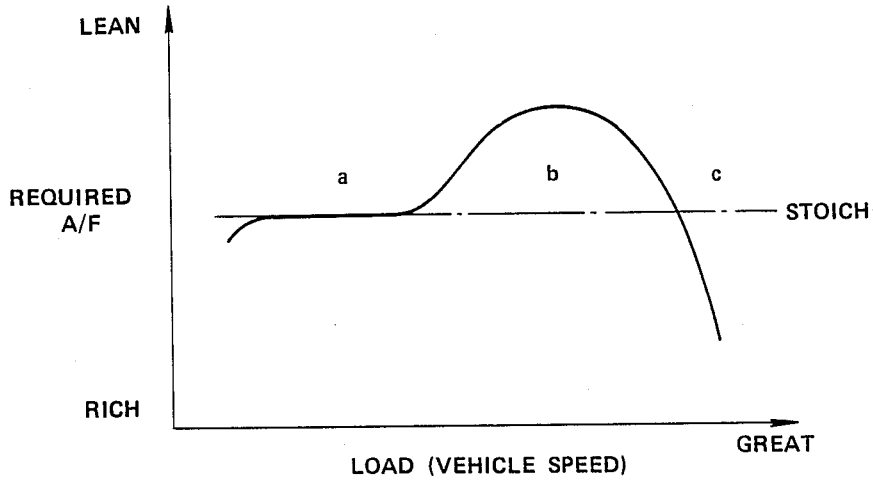

The optimum air/fuel ratio for an engine varies in dependence on the make of the engine, and the engine operating conditions such as warm-up condition and load condition. FIGS. 7 and 8 show, as an example, a relationship of the air/fuel ratio required by an engine versus the engine operating conditions in the steady state.

In a region "a" of FIG. 7 which is frequently used in normal street driving and other situations, it is desired to use the air/fuel ratio near stoichiometry of about 14.7 for three way catalyst and to use a leaner air/fuel ratio for oxidizing catalyst.

In a high speed, high load region "b" of FIG. 7, it is desired to use a leaner-than-stoichiometry air-fuel mixture (A/F=20–23) from the viewpoint of fuel economy although it is possible to use the same air/fuel ratio as in the region "a".

In a high load, fully open region "c" of FIG. 7, it is desired to use a rich mixture (A/F=10–13) in order to obtain high engine output, and cooling effect for preventing engine damage due to exhaust temperature increase.

FIG. 8 shows a relationship between the required air/fuel ratio and engine load, taken along a one-dot chain line A-B of FIG. 7. As is known from FIG. 8, the required air/fuel ratio does not remain constant even in the steady state.

Figure 9:
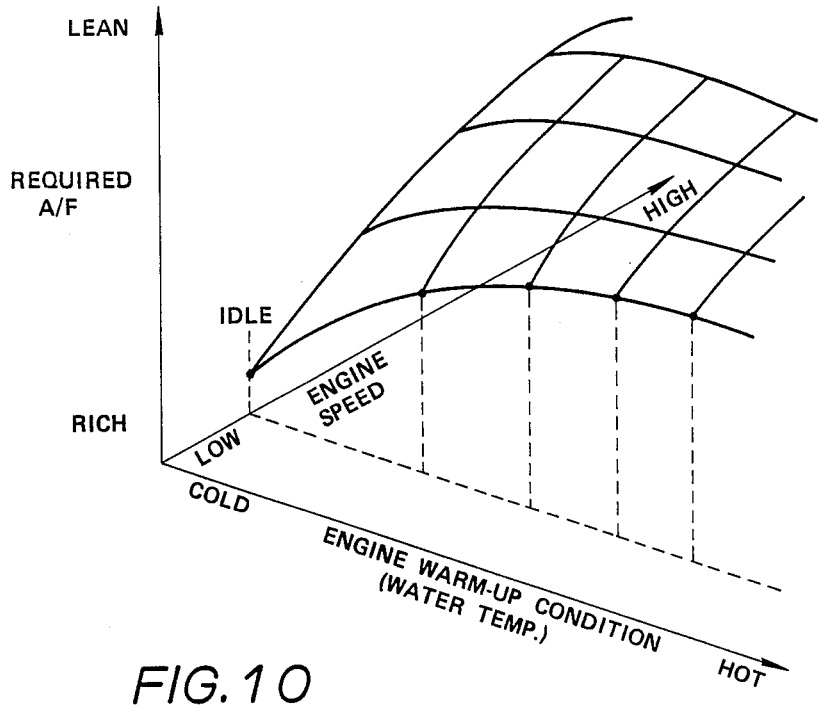
FIG. 9 is a three dimensional map showing the air/fuel ratio required by the engine in a no-load steady state, as a function of engine cooling water temperature and engine speed.

FIG. 9 shows a relationship of the required air/fuel ratio versus an engine warm-up condition such as a coolant temperature in a no-load steady state. The required air/fuel ratio varies in dependence on the engine cooling water temperature and engine speed, as shown in FIG. 9. The air/fuel ratio should be made richer as the cooling water temperature decreases, and as the engine speed decreases.

Accordingly, the control unit 10 determines a desired air/fuel ratio (TL) from the engine speed, rpm, (N), the engine load condition (which is known from the intake air flow rate Qa or the intake manifold vacuum Pv), and the cooling water temperature (Tw).

In the fuel metering system of this embodiment, the fuel supply (injection) quantity is determined by a pulse duration (or pulse width) of the injection control signal Si. The control unit 10 determines the pulse duration Ti of the injection control signal Si by using the following equation.

$$Ti = QA \times Kmr \times Coef \times \alpha + Ts$$

QA is an intake air quantity per cylinder. In the steady state engine operation, QA is calculated from the sensor signal Qa of the air flowmeter 11 shown in FIG. 4, and the engine speed N, and then corrected in accordance with the temperature of the intake air. In the transient state, QA is corrected in accordance with the output Cv of the throttle position sensor 12 and the output Pv of the pressure sensor 10.

Kmr is a factor corresponding to the reciprocal of the required air/fuel ratio. Kmr is determined from the engine speed N, engine load condition and cooling water temperature Tw, like the desired air/fuel ratio TL.

Coef is a factor for correcting the fuel injection quantity during transient state operation, which should be determined in dependence on a percentage of fuel evaporation or a percentage of fuel wall surface flow. For example, the factor Coef is determined in accordance with the magnitude of vehicle acceleration or deceleration, the engine warm-up condition (such as cooling water temperature Tw), and whether a sufficient time has elapsed after start or not.

Figure 10:
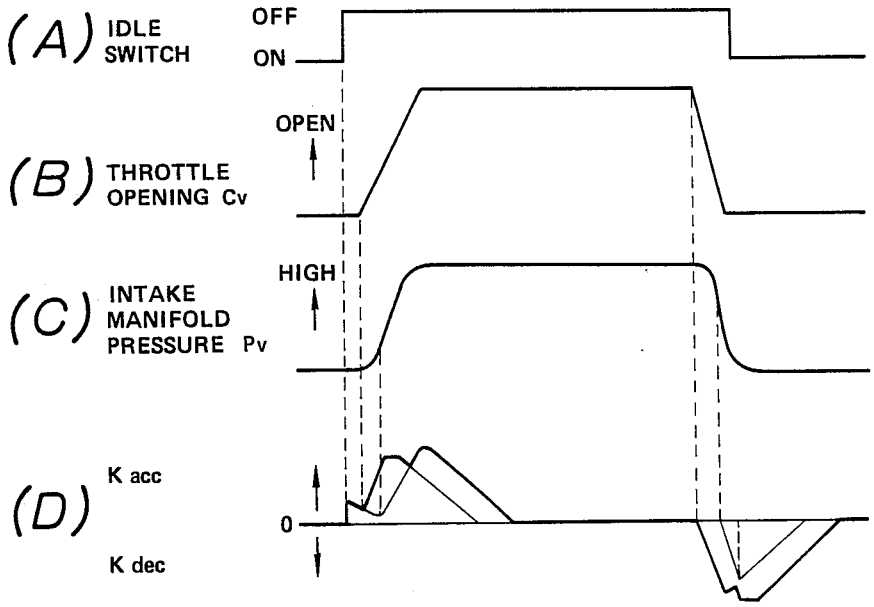
FIG. 10 shows waveforms of various signals for determining an acceleration enrichment coefficient and a deceleration enleanment coefficient.

The factor Coef is determined by using the following equation, for example;

$$Coef=(1+Kacc-Kdec)$$

wherein Kacc is an acceleration enrichment coefficient, and Kdec is a deceleration leaning ("enleanment") coefficient. In the same manner as disclosed in Japanese patent provisional publication No. 58-144642, Kacc and Kdec are varied as shown by a heavy line in a tier (D) of FIG. 10, in accordance with an on-off output of an idle switch (which is on when an accelerator pedal is released, and off when the pedal is depressed), the rate of change of the throttle opening Cv and the rate of change of the intake manifold pressure Pv.

The factor $\alpha$ (alpha) is a feedback correction factor for reducing a deviation between the actal air/fuel ratio (the sensor output Ip) sensed by the oxygen sensor 16 and the detecting circuit 40, and the desired air/fuel ratio TL. This factor $\alpha$ is calculated by the following equations;

$$\alpha=\alpha'\pm Kp\times Dip$$

$$\alpha'=\alpha'(old)\pm Ki\times Dip$$

where $Dip=|Ip-TL|$, Kp is a proportional control constant, Ki is an integral control constant, $\alpha'$ is an integral component and $\alpha'$(old) is an old value of $\alpha'$ determined in the previous calculation. In each of the above equations, before the control constant Kp or Ki, the plus sign is chosen in a lean situation in which the actual air/fuel ratio is greater than the desired air/fuel ratio (lean deviation), and the minus sign is chosen in a rich situation in which the actual air/fuel ratio is smaller than the desired ratio (rich deviation).

Figures 11, 13:
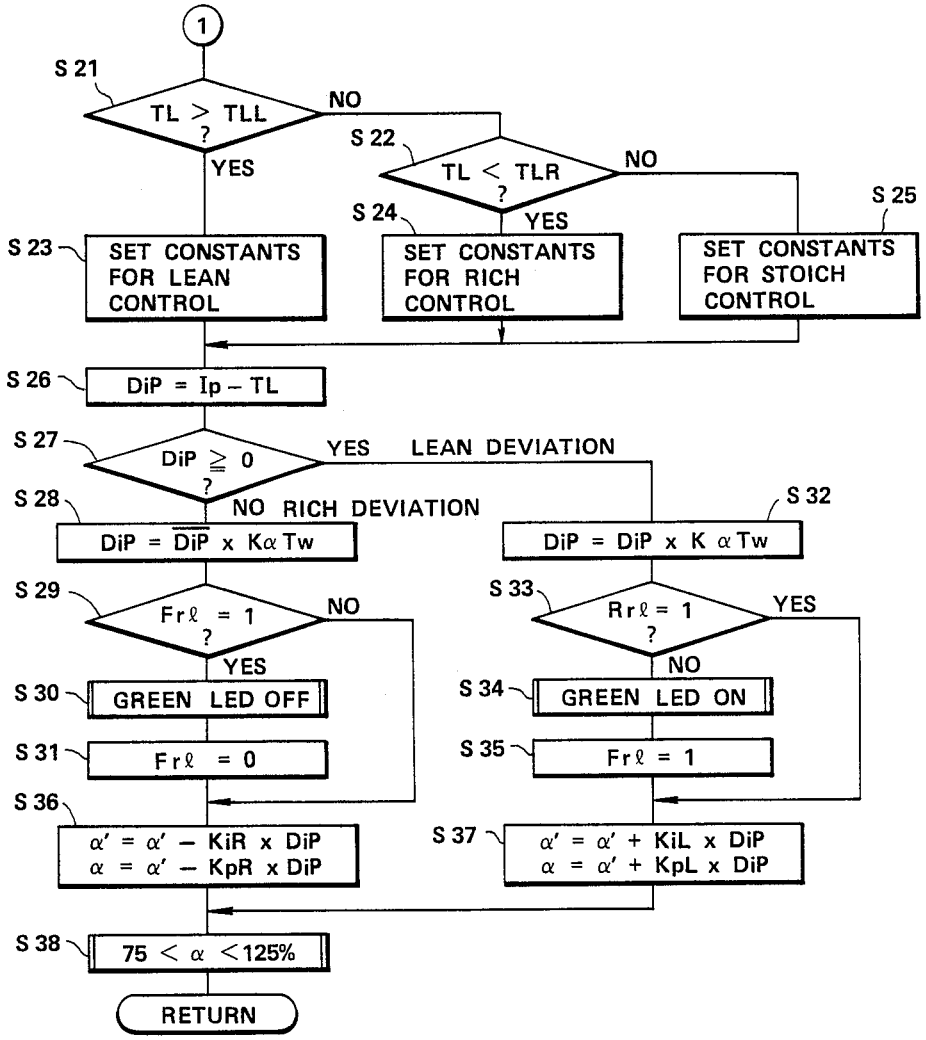
FIG. 11 is a table of proportional gain values and integral gain values use in the control unit of FIG. 4.
FIGS. 12 and 13 are flowcharts showing a control program performed by the control unit of FIG. 4.

The control system of this embodiment is arranged to change both values of the proportional control constant (proportional gain) Kp, and the integral control constant (integral gain) Ki in dependence on whether the desire air/fuel ratio TL is lean, stoichiometric or rich, and whether the actual air/fuel ratio is deviating from the desired ratio TL to the lean side (lean deviation) or to the rich side (rich deviation), as shown in a table of FIG. 11. In the table of FIG. 11, six symbols (consisting of four letters) KpLL, KpLS, . . . KpRR are constant values used as the proportional control constant Kp, and six symbols (consisting of four letters) KiLL, KiLS . . . KiRR are constant values used as the integral control constant Ki. In the lean situation (lean deviation), the proportional control constant Kp is set equal to KpLL, KpLS or KpLR, and the integral control constant Ki is set equal to KiLL, KiLS or KiLR. In each of these six symbols used in the lean situation, the third letter L denotes the lean deviation. In the rich situation (rich deviation), Kp is set equal to one of the constant values represented by the symbols having the letter R, as the third letter after the letters Kp, and Ki is set equal to one of the constant values represented by the symbols having the third letter R after the letters Ki. In each of KpLL, KiLL, KpRL and KiRL of the first row of the table of FIG. 11, the last letter L denotes a lean control in which the desired ratio TL is lean. In each of KpLS, KiLS, KpRS and KiRS of the second row, the least letter S denotes a stoichiometric control in which the desired ratio T1 is stoichiometric. The last letter R of each of KpLR, KiLR, KpRR and KiRR in the last row denotes a rich control in which the desired ratio TL is rich.

The constant values listed in the table of FIG. 11 are determined so as to satisfy the following inequalities.

| | | | | | | | |
|---|---|---|---|---|---|---|---|
| KpLR | < | KpLS | < | KpLL | | | |
| KiLR | < | KiLS | < | KiLL | | | |
| KpRR | < | KpRS | < | KpRL | | | |
| KiRR | < | KiRS | < | KiRL | | | |
| KpRL | < | KpLL | | KpRS | < | KpLS | |
| KpRR | < | KpLR | | | | | |
| KiRL | < | KiLL | | KiRS | < | KiLS | |
| KiRR | < | KiLR | | | | | |

That is, the value of each of the control constants Kp and Ki used in the rich control having the desired ratio TL on the rich side is lower than the value used in the lean control in which the desired ratio TL is on the lean side. The value of each control constant Kp or Ki used in the rich situation is lower than the value used in the lean situation.

In the equation expressing Ti, Ts is an ineffective pulse duration (voltage correction quantity).

Figure 12:
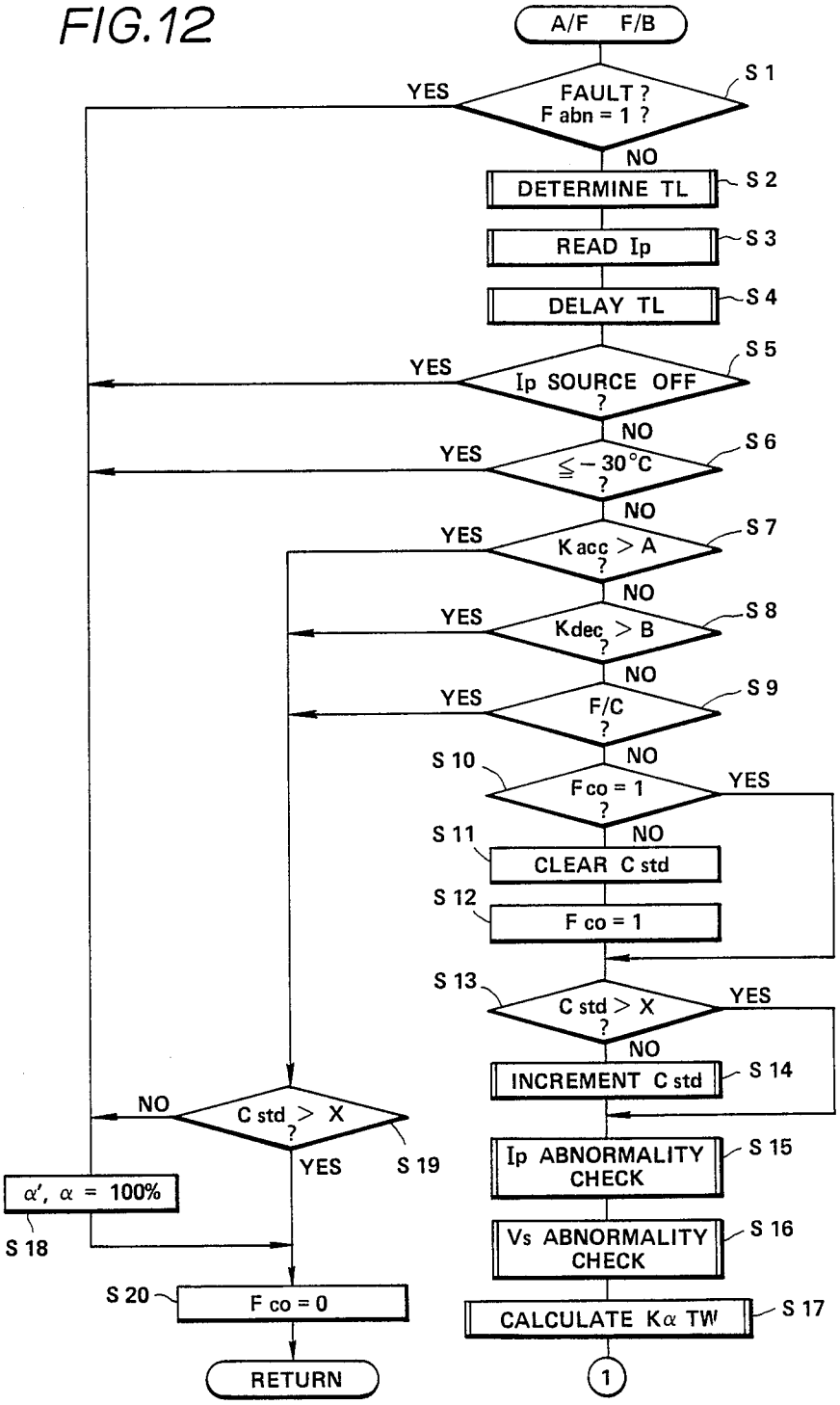

The control unit 10 of this embodiment performs repeatedly an air/fuel ratio feedback control routine shown in FIGS. 12 and 13.

At a first step S1 of the air/fuel ratio feedback routine shown in FIG. 12, the control unit 10 checks if there is any fault in the air/fuel ratio feedback control system. For example, the step S1 uses an abnormality flag Fabn which is set to one, if a fault is present, by another routine, such as a routine for detecting a broken wire of the heating element of the oxygen sensor. If Fabn is equal to one, the control unit 10 proceeds to a step S18 without performing the feedback control. At the step S18, the control unit 10 clamps (fixes) the feedback correction factor $\alpha$ (alpha) (and the integral component $\alpha'$ of the integral control action) at a value equivalent to 100%. Then, the control unit 10 resets a close-open flag Fco to zero at a step S20, and returns to a main routine. That is, an open loop control is performed. The flag Fco is an indicator which signals the period of the feedback control when it is one, and the period of the open loop control when it is zero.

If the abnormality flag Fabn is not equal to zero, the control unit 10 proceeds from the step S1 to a step S2, at which the control unit 10 calculates the desired air/fuel ratio TL in accordance with the engine operating conditions (such as engine speed, engine load and coolant temperature), as mentioned before.

Then, the control unit 10 reads the output Ip of the air/fuel ratio detecting circuit at a step S3, and delays the desired air/fuel ratio TL at a step S4. Because the oxygen sensor is disposed in the exhaust manifold, the response of the feedback control based on the desired air/fuel ratio TL calculated at a given point of time is retarded by an amount of time corresponding to a transport time of the air-fuel mixture from the injectors to the oxygen sensor. The step S4 is designed to delay the desired air/fuel ratio TL by this amount of time.

At a step S5, the control unit 10 determines whether the pump current Ip is cut off or not. The pump current supplier section 43 of the air/fuel ratio detecting circuit 40 is arranged to hold the pump current at zero, for example, when the heating element of the oxygen sensor is not warm enough immediately after a start of the engine. In such a case, it is not possible to detect the actual air/fuel ratio correctly. Therefore, the control unit 10 proceeds to the step S18 to clamp $\alpha$ and $\alpha'$ at 100% if the pump current is not supplied.

If the pump current Ip is present, the control unit 10 further checks whether the engine coolant temperature is equal to or lower than −30° C., or not, at a step S6. When it is very cold, the combustion in the engine is not normal, so that the control cannot be performed accurately. Therefore, the control unit 10 proceeds from the step S6 to the clamping step S18 to start the open loop control if the coolant temperature is equal to or lower than −30° C.

If the coolant temperature is higher than −30° C., the control unit 10 proceeds from the step S6 to a step S7. The step S7 is designed to check whether the acceleration enrichment coefficient Kacc is greater than a predetermined value A (which may be equal to zero). A next step S8 is designed to check whether the deceleration enleanment coefficient is greater than a predetermined value B (which may be equal to zero). A next step S9 is designed to check whether the control system is in a fuel-cut state or not.

If the answer of any one of the steps S7, S8 and S9 is affirmative (YES), the control unit 10 proceeds to a step S19. A step S10 is reached only when all the answers of the steps S7, S8 and S9 are negative (NO).

At the step S19, the control unit 10 determines whether a steady state count Cstd of a steady state counter is greater than a predetermined value X. If the count Cstd is greater than X, the control unit 10 judges that the feedback control is settled to a steady state condition. In this case, therefore, the control unit 10 resets a close-open flag Fco to zero at the step S20, and returns to the main routine. In this case, $\alpha$ and $\alpha'$ are clamped (fixed) at the existing values of $\alpha$ and $\alpha'$ which were calculated in the previous calculation, and the open loop control is performed. If the feedback control is settled at $\alpha = 110\%$, for example, then the correction factor $\alpha$ is held equal to 110%.

If the count Cstd is not greater than X, the control unit 10 clamps $\alpha$ and $\alpha'$ at 100% at the step S18, and performs the open loop control because the steady state condition has not yet been reached.

If all the answers of the steps S7, S8 and S9 are NO, then the control unit 10 performs the closed loop control. The control unit 10 checks the close-open flage Fco at the step S10. If Fco = 1, the control unit 10 jumps to a step S13 bypassing steps S11 and S12 in accordance with the judgement that the feedback control was performed in the previous operation cycle. If the open loop control was performed in the previous cycle, and therefore Fco is zero, then the control unit 10 proceeds to the step S13 through the steps S11 and S12. The control unit 10 clears the steady state counter for providing the count Cstd to its initial state, at the step S11, and sets the flag Fco to one to indicate the feedback control state, at the step S12.

At the step S13, the control unit 10 determines whether the count Cstd is greater than the predetermined value X or not. If it is, the control unit 10 skips a next step S14, and goes to a step S15. If Cstd is not greater than X, the control unit 10 increments (increases by one) Cstd at the step S14.

At the step S15, the control unit 10 performs an Ip abnormality check. If the output voltage Vi corresponding to Ip, of the air/fuel ratio detecting circuit is equal to 0 V or 5 V (the voltage of the source), then the control unit 10 regards Ip as abnormal.

At a next step S16, the control unit 10 checks whether the output voltage Vs of the sensor electrode of the oxygen sensor 16 is abnormal or not. That is, it is determined whether Vs is held at the predetermined constant value, for example, 0.4 V.

At a step S17, the control unit 10 calculates a coolant temperature correction coefficient K TW, which is used for adjusting the proportional control constant and the integral control constant of the feedback correction factor $\alpha$ in dependence on the engine coolant temperature to prevent hunting by decreasing the speed of the feedback control when the coolant temperature is low.

Then, the control unit 10 proceeds from the step S17 of FIG. 12 to a step S21 shown in FIG. 13.

At the step S21, the control unit 10 determines whether the desired air/fuel ratio TL is greater than a predetermined lean slice value TLL. If it is, the control unit 10 proceeds to a step S23 for the lean control. If TL is not greater than TLL, then the control unit 10 determines, at a step S22, whether TL is smaller than a predetermined rich slice value TLR which is smaller than TLL. If TL is smaller than TLR, the control unit 10 proceeds to a step S24 for the rich control. If TL is not smaller than TLR, a step 25 for the stoichiometric control is chosen. Thus, the control unit 10 compares the desired air/fuel ratio TL with the predetermined values TLL and TLR, and selects one of the three steps S23, S24 and S25.

The control unit 10 sets the constant values KpLL, KiLL, KpRL and KiRL for the lean control at the step S23, sets the constant values KpLR, KiLR, KpRR and KiRR for the rich control at the step S24, and sets the constant values KpLS, KiLS, KpRS and KiRS for the stoichiometric control at the step S25.

The steps S21 and S22 correspond to the reference discriminating means 105 shown in FIG. 1, and the steps S23, S24 and S25 correspond to the control constant adjusting means 106 of FIG. 1.

At a step S26 following the step S23, S24 or S25, the control unit 10 calculates a difference Dip (=Ip−TL) between the actual air/fuel ratio Ip and the desired air/fuel ratio TL. At a next step S27, the control unit 10 determines whether the difference DiP is equal to or greater than zero. If DiP is smaller than zero, that is, there exists the rich situation in which the actual air/fuel ratio deviates from the desired air/fuel ratio to the richer side (rich deviation), then the control unit 10 enters a course of steps S28–S36. The control unit 10 adopts a course of steps S32–S37 if DiP is greater than zero (lean deviation) or DiP is equal to zero (the actual ratio is equal to the desired ratio).

At the step S28, the control unit 10 multiplies the absolute value $\overline{DiP}$ of the difference DiP (which is negative in this case) by the coolant temperature correction coefficient KαTW determined at the step S17, and registers the product obtained by this multiplication as a new value of DiP.

At the step S29, the control unit 10 checks a rich-lean flag Frl which indicates the lean deviation when it is one, and the rich deviation when it is zero.

If Fr1 is equal to one, a green LED is turned off at the step S30 to indicate a change from the lean deviation in the previous cycle to the rich deviation in the current cycle, and then the flag Fr1 is reset to zero at the step S31. The green LED is provided in the control unit, and switched on and off intermittently during the lambda control to indicate the operating condition. (It is switched on in the rich deviation, and switched off in the lean deviation.) If Fr1 is not equal to one, then the control unit 10 proceeds from the step S29 to the step S36 bypassing the steps S30 and S31.

In the case of the lean deviation, the control unit 10 registers, as a new value of DiP, the product obtained by multiplying DiP (which is positive) by the coolant temperature correction coefficient K TW, at the step S32, and checks, at the step S33, whether Fr1 is equal to one. If Fr1 is not equal to one, the control unit 10 turns the green LED on at the step S34 to indicate a change of the rich deviation of the previous cycle to the lean deviation of the current cycle, and then sets the flag Fr1 to one at the step S35. If Fr1 is equal to one, then the control unit 10 skips the steps S34 and S35 and goes to the step S37.

At a selected one of the alternative steps S36 and S37, the control unit 10 calculates the feedback correction factor α (alpha) and the integral component α′ by using the control constant values set at any one of the steps S23, S24 and S25. The integral component α′ is the amount of an integral control action to reduce a steady state error to zero.

The step 36 is to calculate α and α′ for the rich deviation. The integral component α′ is calculated from the old value of α′ calculated in the previous cycle, a rich deviation integral control constant KiR which is set equal to KiRL, KiRR or KiRS at the step S23, S24 or S25, and DiP registered at the step S28 by using the following equation.

$$\alpha' = \alpha'(old) - KiR \times DiP$$

In this equation, KiR×DiP is subtracted from α′(old) because of the rich deviation. The feedback correction factor α is calculated from the integral component α′ calculated by the above equation, a rich deviation proportional control constant KpR which is set equal to KpRL, KpRR or KpRS at the step S23, S24 or S25, and DiP registered at the step S28 by using the following equation.

$$\alpha = \alpha' - KpR \times DiP$$

In this equation, KiR×DiP is subtracted from α′ in order to reduce the rich deviation by decreasing α.

At the step S37, α and α′ for the lean deviation are calculated by using the following equations.

$$\alpha' = \alpha'(old) + KiL \times DiP$$

$$\alpha = \alpha' + KpL \times DiP$$

In each of the above equations, the plus sign is used instead of the minus sign. KiL is a lean deviation integral control constant which is set equal to KiLL, KiLR or KiLS at the step S23, S24 or S25, and KpL is a lean deviation proportional control constant which is set equal to KpLL, KpLR or KpLS at the step S23, S24 or S25. DiP is the value registered at the step S32.

Finally, the control unit 10 limits the feedback correction factor α between a lower limit of 75% and an upper limit of 125%, at a step S38, and then returns to the main routine, in which the fuel injection pulse duration Ti is calculated, and the corrective action of the feedback control is applied to the controlled system.

The thus-arranged air/fuel ratio control system of the present invention can provide an adequate feedback control gain well adapted to the characteristic of the oxygen sensor over the wide air/fuel ratio range from the rich extremity to the lean extremity, so that the fuel economy, exhaust emission and drivability can be improved.

What is claimed is:

1. An air/fuel ratio control system for an internal combustion engine, comprising:

metering means for varying an air fuel ratio of an air-fuel mixture supplied to said engine in response to a control signal, an air/fuel ratio sensor for sensing an actual air/fuel ratio of said engine, reference determining means for determining a desired air/fuel ratio in accordance with an operation condition for said engine, controlling means for comparing said actual air/fuel ratio sensed by said air/fuel ratio sensor with said desired air/fuel ratio determined by said reference determining means, and controlling said air/fuel ratio of said air-fuel mixture so as to reduce a deviation of said actual air/fuel ratio from said desired air/fuel ratio by producing said control signal in accordance with said deviation by using a value of a feedback control constant which is a gain of a prescribed control action which is applied to aid deviation by said controlling means, and which is one of a proportional gain of a proportional control action, and an integral gain of an integral control action, discriminating means for comparing said desired air/fuel ratio determined by said reference determining means with a predetermined value, and adjusting means for changing the value of said feedback control constant used by said controlling means in dependence upon a result of the comparison performed by said discriminating means.

2. An air/fuel ratio control system according to claim 1 wherein said adjusting means sets said feedback control constant equal to a rich control constant value when said desired air/fuel ratio is in a rich range, and equal to a lean control constant value higher than said rich control constant value when said desired air/fuel ratio is in a lean range.

3. An air/fuel ratio control system according to claim 2 wherein said discriminating means compares said desired air/fuel ratio with a predetermined rich slice value and a predetermined lean slice value which is greater than said rich slice value, and said adjusting means sets said feedback control constant to said rich control constant value when said desired air/fuel ratio is smaller than said rich slice value, to said lean control constant value when said desired air/fuel ratio is greater than said lean slice value, and to a stoichiometric control constant value smaller than said lean control constant value and greater than said rich control constant value when said desired air/fuel ratio is smaller than said lean slice value and greater than said rich slice value.

4. An air/fuel ratio control system for an internal combustion engine, comprising:

metering means for varying an air fuel ratio for an air-fuel mixture supplied to said engine in response to a control signal.

an air/fuel ratio sensor for sensing an actual air/fuel ratio of said engine, reference determining means for determining a desired air/fuel ratio in accordance with an operating condition for said engine, controlling means for comparing said actual air/fuel ratio sensed by said air/fuel ratio sensor with said desired air/fuel ratio determined by said reference determining means, and controlling said air/fuel ratio of said air-fuel ratio from said desired air/fuel ratio by producing said control signal in accordance with said deviation by using a value of a feedback control constant, discriminating means for comparing said desired air/fuel ratio determined by said reference determining means with a predetermined value, and adjusting means for changing the value of said feedback control constant used by said controlling means in dependence upon a result of the comparison performed by said discriminating means, said feedback control constant is a gain of a prescribed control action implemented by said controlling means, said adjusting means sets said feedback control constant equal to a rich control constant value when said desired air/fuel ratio is in a rich range, and equal to a lean control constant value higher than said rich control constant value when said desired air/fuel ratio is in a lean range, said adjusting means sets said feedback control constant to a higher lean control constant value KLL if said desired air/fuel ratio is in said lean range and said actual air/fuel ratio is greater than said desired air/fuel ratio, to a lower lean control constant value KRL lower than said higher lean control constant value KLL if said desired air/fuel ratio is in said lean range and said actual air/fuel ratio is smaller than said desired air/fuel ratio, to a higher rich control constant value KLR lower than said higher lean control value KLL if said desired air/fuel ratio is in said rich range and said actual air/fuel ratio is greater than said desired air/fuel ratio, and to a lower rich control constant value KRR and lower than said lower lean control constant value KRL and lower than said higher rich control constant value KLR if said desired air/fuel ratio is in said rich range and said actual air/fuel ratio is smaller than said desired air/fuel ratio.

5. An air/fuel ratio control system for an internal combustion engine, comprising:

metering means for varying an air fuel ratio of an air-fuel mixture supplied to said engine in response to a control signal, an air/fuel ratio sensor for sensing an actual air/fuel ratio of said engine, reference determining means for determining a desired air/fuel ratio in accordance with an operating condition for said engine, controlling means for comparing said actual air/fuel ratio sensed by said air/fuel ratio sensor with said desired air/fuel ratio determined by said reference determining means, and controlling said air/fuel ratio of said air-fuel mixture so as to reduce a deviation of said actual ratio from said desired air/fuel ratio by producing said control signal in accordance with said deviation by using a value of a feedback control constant, discriminating means for comparing said desired air/fuel ratio determined by said reference determining means with a predetermined value, and adjusting means for changing the value of said feedback control constant used by said controlling means in dependence upon a result of the comparison performed by said discriminating means, said feedback control constant is a gain of a prescribed control action implemented by said controlling means, said adjusting means sets said feedback control constant equal to a rich control constant value when said desired air/fuel ratio is in a rich range, and equal to a lean control constant value higher than said rich control constant value when said desired air/fuel ratio is in a lean range, said discriminating means compares said desired air/fuel ratio with a predetermined rich slice value and a predetermined lean slice value which is greater than said rich slice value, and said adjusting means sets said feedback control constant to said rich control constant value when said desired air/fuel ratio is smaller than said rich slice value, to said lean control constant value when said desired air/fuel ratio is greater than said lean slice value, and to a stoichiometric control constant value smaller than said lean control constant value and greater than said rich control constant value when said desired air/fuel ratio is smaller than said lean slice value and greater than said rich slice value, said adjusting means sets said feedback control constant to a higher lean control constant value KLL if said desired air/fuel ratio is greater than said lean slice value and said actual air/fuel ratio is greater than said desired air/fuel ratio, to a lower lean control constant value KRL if said desired air/fuel ratio is greater than said lean slice value and said actual air/fuel ratio is smaller than said desired air/fuel ratio to a higher rich control constant value KRL if said desired air/fuel ratio is smaller than said rich slice value and said actual air/fuel ratio is greater than said desired air/fuel ratio to a lower rich control constant value KRR if said desired air/fuel ratio is smaller than said rich slice value and said actual air/fuel ratio is smaller than said desired air/fuel ratio, to a higher stoichiometric control constant value KLS if said desired air/fuel ratio is between said lean and rich slice values and said actual air/fuel ratio is greater than said desired air/fuel ratio, and to a lower stoichiometric control constant value KRS if said desired air/fuel ratio is between said lean and rich slice values and said actual air/fuel ratio is smaller than said desired air/fuel ratio, said higher rich control constant value KLR is lower than said higher stoichiometric control constant value KLS, said higher stoichiometric control constant value KLS being lower than said higher lean control constant value KLL<said lower rich constant value KRR being lower than said lower stoichiometric control constant value KRS, said lower stoichiometric control constant value KRS being lower than said lower lean control constant value KRL, said lower lean control constant value KRL being lower than said higher lean control constant value KLL, said lower stoichiometric control constant value KRS being lower than said higher stoichiometric control constant value KLS, said lower rich control constant value KRR being lower than said higher rich control constant value KLR.

6. An air/fuel ratio control system according to claim 5 wherein said feedback control constant is a proportional gain of a proportional control action.

7. An air/fuel ratio control system according to claim 6 wherein said controlling means produces said control signal according to a proportional plus integral control action by using said proportional gain and an integral gain, and said adjusting means adjusts not only said proportional gain but also said integral gain.

8. An air/fuel control system according to claim 7 wherein said adjusting means stores twelve constant values, KpLL, KpLS, KpLR, KiLL, KiLS, KiLR, KpRL, KpRS, KpRR, KiRL, KiRS and KiRR, and sets said proportional gain and said integral gains, respectively, to KpLL and KiLL if said desired air/fuel ratio is greater than said lean slice value and said actual air/fuel ratio is greater than said desired air/fuel ratio, to KpLS and KiLS if said desired air/fuel ratio is between said lean and rich slice values and said actual air/fuel ratio is greater than said desired air/fuel ratio, to KpLR and KiLR if said desired air/fuel ratio is smaller than said rich slice value and said actual air/fuel ratio is greater than said desired air/fuel ratio, to KpRL and KiRL if said desired air/fuel ratio is greater than said lean slice value and said actual air/fuel ratio is smaller than said desire air/fuel ratio, to KpRS and KiRS if said desired air/fuel ratio is between said lean and rich slice values and said actual air/fuel ratio is smaller than said desire air/fuel ratio, and to KpRR and KiRR if said desired air/fuel ratio is smaller than said rich slice value and said actual air/fuel ratio is smaller than said desired air/fuel ratio, said twelve constant values satisfying the following inequalities:

| | | | | | | | |
|---|---|---|---|---|---|---|---|
| KpLR | < | KpLS | < | KpLL, | | | |
| KiLR | < | KiLS | < | KiLL, | | | |
| KpRR | < | KpRS | < | KpRL, | | | |
| KiRR | < | KiRS | < | KiRL, | | | |
| KpRL | < | KpLL, | | | KpRS | < | KpLS, |
| KpRR | < | KpLR, | | | | | |
| KiRL | < | KiLL, | | | KiRS | < | KiLS, |
| KiRR | < | KiLR. | | | | | |

9. An air/fuel ratio control system according to claim 8 wherein said controlling means determines a feedback corrective factor in accordance with said deviation by using the value of said feedback control constant set by said adjusting means, and produces said control signal so that said control signal represents a fuel supply quantity which is equal to a sum of a predetermined first quantity and a second quantity obtained by multiplying a predetermined multiplicand by said feedback corrective factor.

10. An air/fuel ratio control system according to claim 9 wherein said multiplicand is a product obtained by multiplying a basic fuel supply quantity by a transient state correction factor.

11. An air/fuel ratio control system according to claim 10 wherein said controlling means regularly repeats a calculation of said feedback corrective factor, which is equal to a sum of a proportional component quantity which is a product obtained by multiplying said deviation by said proportional gain, and an integral component quantity which is a sum of a previous value of said integral component quantity determined in a previous calculation, and a product obtained by multiplying said deviation by said integral gain.

12. An air/fuel ratio control system according to claim 11 wherein said metering means comprises at least one fuel injector, and said control signal represents a fuel injection quantity.

13. An air/fuel ratio control system according to claim 12 wherein said air/fuel ratio sensor comprises an oxygen sensor which is exposed to an exhaust gas mixture of said engine, and which is a type capable of sensing said actual air/fuel ratio over a wide range from a lean side to a rich side.

14. An air/fuel ratio control system according to claim 13 wherein said reference determining means determines said desired air/fuel in accordance with an engine speed, an engine load and an engine temperature of said engine.

* * * * *